US006779214B2

(12) United States Patent
Klopf

(10) Patent No.: US 6,779,214 B2
(45) Date of Patent: Aug. 24, 2004

(54) METHOD FOR THE PRODUCTION OF FITTED FOOTWEAR

(76) Inventor: Michael Klopf, Karmelitenstrasse 36, 97070 Würzburg (DE)

( * ) Notice: Subject to any disclaimer, the term of this patent is extended or adjusted under 35 U.S.C. 154(b) by 0 days.

(21) Appl. No.: 10/148,700

(22) PCT Filed: Dec. 12, 2000

(86) PCT No.: PCT/DE00/04425

§ 371 (c)(1),
(2), (4) Date: May 31, 2002

(87) PCT Pub. No.: WO01/58299

PCT Pub. Date: Aug. 16, 2001

(65) Prior Publication Data

US 2002/0189136 A1 Dec. 19, 2002

(30) Foreign Application Priority Data

Feb. 8, 2000 (DE) ..... 100 05 485

(51) Int. Cl.[7] ..... A43B 3/00
(52) U.S. Cl. ..... 12/142 R; 36/100; 36/101
(58) Field of Search ..... 36/100, 101, 18, 36/47, 97; 12/142 R, 142 C

(56) References Cited

U.S. PATENT DOCUMENTS 3,354,487 A * 11/1967 Glassman et al. ..... 12/142 R
3,990,159 A * 11/1976 Borgeas ..... 36/101
4,300,294 A * 11/1981 Riecken ..... 36/97
4,505,055 A * 3/1985 Bergmans ..... 36/18
5,185,945 A * 2/1993 Nielsen et al. ..... 36/77 R

FOREIGN PATENT DOCUMENTS

| | | | |
|---|---|---|---|
| CH | 666599 | * | 8/1988 |
| DE | 2639482 | * | 3/1978 |
| DE | 3934080 | * | 12/1990 |
| GB | 617903 | * | 2/1949 |
| GB | 2289613 | * | 11/1995 |

* cited by examiner

*Primary Examiner*—Ted Kavanaugh
(74) *Attorney, Agent, or Firm*—Birch, Stewart, Kolasch & Birch, LLP

(57) ABSTRACT

The invention relates to a method for the production of fitted footwear, in particular, fitted shoes, by using a pre-prepared sole (1), a pre-formed strip (6) and an insert (5). The construction takes place on the foot of the eventual shoe-wearer, whereby a pre-prepared sole (1), corresponding to the dimensions of said shoe-wearers foot is searched out. An insert (5) is applied to the sole (1) and the precise fit of the sole (1) and insert checked on the foot. A pre-formed strip (6) is placed over the foot of the eventual shoe-wearer and fitted to the pre-prepared sole (1). The invention further relates to footwear prepared according to said method.

6 Claims, 1 Drawing Sheet

METHOD FOR THE PRODUCTION OF FITTED FOOTWEAR

Figure 1:
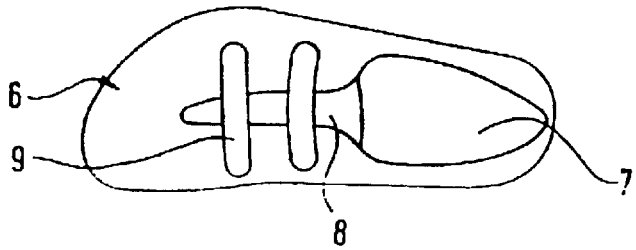

This application is the national phase under 35 U.S.C. §371 of PCT International Application No. PCT/DE00/04425 which has an International filing date of Dec. 12, 2000, which designated the United States of America.

The invention relates to a method for the production of fitted footwear, in particular fitted shoes, by using a prefabricated sole, a preformed upper and an insert.

The invention further relates to footwear produced according to this method.

The human foot, by virtue of its composition of 26 bones, 107 ligaments and 19 muscles, is a highly complex body part. For this reason, Leonardo da Vinci described the foot as a work of art. It is not necessary to hold this opinion to recognise that a shoe bought off the rack cannot always meet the individual requirements of the shoe wearer, and is also not always intended to. This is particularly, but not exclusively, true of persons who, as a result of foot deformities or other orthopaedic peculiarities, cannot use shoes off the rack and adapted to the average foot. This group is accordingly dependent on the fitting of individual footwear tailored to their foot. Other groups of people make recourse to fitted footwear not out of orthopaedic considerations but because fitted footwear can be particularly well adapted to the foot and can increase physical wellbeing. The term footwear is intended to include, inter alia, shoes, boots and other foot covering, but not stockings, socks or the like.

The procedure known in the prior art for producing fitted footwear consists firstly in making a measurement on the foot of the subsequent shoe wearer to determine all essential parameters. In the event of incorrect positioning of the foot, a foot casting or impression is then taken, according to which an orthopaedic shoe insert is produced. By means of the determined dimensions of the foot, a flat leather blank, known as the upper, is cut to size. Then, corresponding to the determined dimensions, a model of the dimensioned foot is to be produced, an approximately fitting last being used for the sake of simplicity or comfort. The leather or the upper is then drawn over this model and the sole is bonded thereon, usually by stitching and/or adhesive bonding. So far as necessary, the orthopaedic shoe insert is applied on the last, otherwise an insert conventional in the prior art is used.

The above-described process is a very complicated and time-consuming process of craftmanship, especially when a replicating model of the foot, i.e. a last is produced. Correspondingly, the production of a fitted shoe takes about 4 to 6 weeks. Because of the required effort, the cost of a fitted pair of shoes is comparatively high.

Another disadvantage is that, after stitching together and/or adhesive bonding, no more corrections can be made to the shoe if this proves necessary, for example during fitting. A model of the foot is of course not capable of indicating the subjective wearing comfort of the shoe wearer.

On the basis of the disadvantages described above, the invention has set itself the objective of providing a method for producing fitted foowear that eliminates the disadvantages contained in the state of the art, that is to say in particular reduces the time and the effort for fitted fabrication, so that fitted shoes will be significantly lower in price. At the same time, however, the need for modifications after production should be as far as possible avoided, and/or it should be possible for modifications to be made where necessary.

These objects are solved in the gist of the invention in that a prefabricated sole corresponding to the dimensions of the foot of the subsequent shoe wearer is selected, the accuracy of fit of the prefabricated sole and the insert applied thereto is checked on the foot of the subsequent shoe wearer by pushing a preformed upper over the foot of the subsequent shoe wearer and joining the preformed upper to the prefabricated sole with an accurate fit. The construction of the footwear is carried out step by step directly on the foot of the subsequent shoe wearer, so that, on one hand, it is not necessary to make a model of the foot, on the other hand, direct feedback about the accuracy of fit and wearing comfort is obtained. Correspondingly, a prefabricated sole is selected according to the dimensions of the foot of the subsequent shoe wearer, and an insert is applied onto the sole. The term "insert" in this context means everything that is disposed between the sole and the foot, and comprises part of the footwear. The accuracy of fit of the prefabricated sole and of the applied insole is checked on the foot, for example by the subsequent shoe wearer standing up and giving his opinion about the wearing comfort and the accuracy of fit. If appropriate, the prefabricated sole and insert can be exchanged until no more objections are raised. Subsequently a preformed upper is pushed over the foot of the subsequent shoe wearer. The upper must of course be chosen such that it fits the sole size and foot size. Thus, a plurality of preformed uppers in various standard sizes corresponding to the prefabricated soles should be held in readiness. Subsequently the preformed upper is joined to the prefabricated sole with accurate fit.

The method contains several advantages. On one hand it is not necessary to prepare a model of the subsequent shoe wearer; measurement of the foot for this purpose is therefore also superfluous. This already saves time and material. On the other hand, at each step it is possible to consult the customer about to what extent the measures taken promote the wearing comfort of the resulting footwear. Only when the subsequent shoe wearer no longer makes complaints does the joining of the preformed upper and prefabricated sole take place. The need for corrections is almost entirely ruled out because of the continuous consultation with the customer. The method thus allows the rapid and direct production of the footwear with continuous checking of the construction for accuracy of fit. Changes can be made directly and with little effort.

Other advantageous embodiments of the invention are the subject of sub-claims.

It is advantageous not to carry out the joining of the prefabricated sole and preformed upper directly on the customer's foot. It is therefore proposed, before joining of the sole and upper, to determine, by means of a measuring device, the height at which the upper should be bonded to the sole with accurate fit. The term measuring device is to be understood in very general terms. For example, a linear rule or a template may be used, or a size stick for the foot; in the simplest alternative, during build up of the footwear on the customer's foot, marks are applied on the preformed upper and/or on the prefabricated sole, which indicate at which height on the upper joining must take place for an accurate fit. Thereafter, joining may take place by means of the marks.

The method according to the invention can in particular be applied to the production of orthopaedic footwear. In this field of application, an orthopaedic insert or appliance must be used as insert, which naturally should be adapted to individual needs. The corresponding measures for this are known to the person skilled in the art. Both active and passive inserts can be used.

It is advantageous to apply the insert or the orthopaedic insert detachably to the prefabricated sole. This may be carried out by laying the insert in an accurately fitting and undisplaceable manner in the sole, or detachably attaching it thereto. The detachable insert can thus be exchanged during the construction of the shoe by removing it and exchanging it for another insert, which better corresponds to the wishes of the subsequent shoe wearer, and is of course applied detachably. Inserts can thus be tested, in so far as this is permitted by the construction of the shoe, that is to say in particular the joining of the prefabricated sole to the preformed upper is not yet completed.

It is furthermore preferred that the preformed upper is detachably joined to the prefabricated sole. It is in particular proposed to stitch the upper and sole in a detachable manner. It cannot be ruled out that, despite consultation with the subsequent shoe wearer during the production of the footwear, corrections or modifications may still need to be made after completion. Thus, it is for example conceivable that modified orthopaedic needs must be taken into account, for example by the necessity to subsequently raise the orthopaedic insert. In this case, the preformed upper and prefabricated sole can be separated, for example by opening the connecting seam. Then the detachably applied insert can be exchanged and the upper and sole reconnected, preferably in a detachable manner again, e.g. by detachable stitching.

In a further embodiment of the invention, the preformed upper should extend essentially vertically in its edge region facing the sole, that is to say not be inwardly curved in the region of the sole, as is conventional in the state of the art. In this manner, it is readily possible to adapt the stitching height of the upper to the sole of the customer's foot by shifting it vertically until the subsequent shoe wearer reports an accurate fit. In the case of an upper that is inwardly curved at its lower side, vertical adjustment is only possible to a restricted extent, if at all. Correspondingly, the toe puff and counter puff stiffening the toe and heel regions must be laterally adapted to the particular stitching height.

In the production of orthopaedic shoes, aesthetic aspects should of course also be taken into account. By virtue of the proposed joining around the sole edge of the preformed upper to the prefabricated sole, with very thick soles and inserts it is possible to give the impression of a very low overall height. The thick sole and/or insert is in this manner partly optically concealed.

Cases are conceivable in which, for example, with a special widening of the foot, an enlargement of the prefabricated sole is necessary. It is then advantageous to slit open a prefabricated sole, to enlarge it by introducing a wedge-shaped insert, and then bond the sole and insert to one another. On this widened sole, the footwear can then be built up according to the method described above. With this method, it is achieved that largely standard prefabricated soles can be used, which can be readily held in readiness. By the described method of enlargement, the prefabricated soles can be variably adapted to a foot form that does not correspond to the average, so that no special production of the sole is necessary, which would involve extra time consumption.

A robustly made shoe can be worn for many years. However, the sole wears down, so that it may be necessary to exchange this instead of having new footwear made. To achieve this, the prefabricated sole is separated from the preformed upper, the insert is removed from the sole and applied to a new prefabricated sole, and the new sole is joined to the preformed upper, for example by stitching. Of course, the old insert can be exchanged for a new one, if appropriate the new insert can be modified with respect to the exchanged insert to take account of, for example, orthopaedic needs. For reasons of cost, exchange of the sole and/or the insert is to be preferred over new production. With the proposed method, it is also possible to exchange the preformed upper when this has become necessary or, for example, is desired by the shoe wearer, e.g. for reasons of fashion. These subsequent changes are in principle possible by virtue of the detachable joining of the preformed upper and prefabricated sole and/or insert.

Fitted footwear that is made by the production method according to the invention is claimed automatically as an independent result of the object of the invention. Therefore it covers not only orthopaedic shoes produced according to the method, but also all kinds of shoes, such as, inter alia, leisure and sports shoes, work shoes and normal street shoes.

Figure 2:
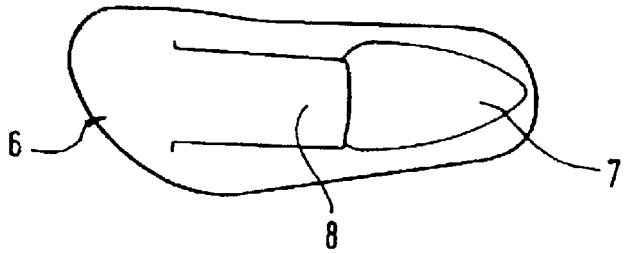
Figure 3:
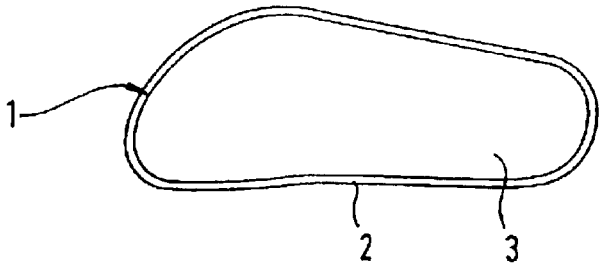
Figure 4:
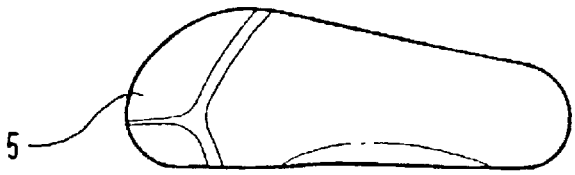

Further details, features and advantages of the invention can be taken from the following descriptive part, in which exemplary embodiments of the invention are explained in greater detail with reference to drawings, in which:

FIG. 1 shows a view from above of a prefabricated sole, an insert and a preformed upper, FIG. 2 shows a view from below of a preformed upper, FIG. 3 shows a view from above of a prefabricated sole, and FIG. 4 shows a view from above of an insert.

FIGS. 1 to 4 show a prefabricated sole designated (1), which is essentially formed as a planar-extending sheet in the shape of an outline of a foot. On the side underside of the sole (1), which faces downwards and can therefore not be seen, it has a profile for improving grip with the floor, as is known to a person skilled in the art. On the top side, an essentially vertically upwardly extending thin-walled edge (2) is formed so as to surround the edge. This sole (1) is expediently produced from one piece, and is held in various standard shoe sizes. The vertically upwardly extending edge (2) on the top side is not inevitably necessary, but facilitates sewing to the preformed upper (6). Into the sole bed, formed by the surrounding, upwardly extending edge (2) and the sole plate (3), there can be introduced an insert (5), which is produced from materials known in the prior art, and is essentially formed as a negative of the foot sole of the subsequent wearer. For lateral foot stabilization, the insert extends on the topside increasingly vertically upwardly towards the edge, so that the foot sole, especially at the heel and inner and outer longitudinal arch, is held firmly from below and from the side. The exterior dimensions are chosen such that the insert (5) is inserted with accurate fit into the sole bed of the prefabricated sole (1). The preformed upper (6) has at the top an essentially oval insertion opening (7) for the foot; on the top side, the tongue (8) and lace elements (9) can also be seen; in the exemplary embodiment shown here, hook-and-loop fastenings (9) are provided. The tongue (8) can also be provided with a tongue padding between the outer leather and lining. The form of the upper (6) corresponds to embodiments known in the prior art, with the exception of the fact that the preformed upper (6), on the side facing the sole (1) extends essentially vertically, as shown in FIG. 2, which shows a view from below of a preformed upper (6). It is thus, in particular, not inwardly curved as is known from the prior art. Uppers (6) in various sizes fitting the prefabricated soles (1) are also, like the prefabricated soles (1) and typical inserts (5), held in stock in various standard sizes.

What is claimed is:

1. A method for producing fitted shoes, the method comprising:

selecting a sole that corresponds to dimensions of a foot of a user;

providing an insert that has a lower surface and a foot receiving area, the lower surface of the insert being positioned on an upper surface of the sole;

placing the foot of the user onto the foot receiving area of the insert;

determining whether the dimensions of the foot of the user correspond with dimensions of the insert and sole;

placing a pre-formed upper over the foot of the user after the determination has been made that the dimensions of the foot of the user correspond with the dimensions of the insert and sole, the pre-formed upper having a portion thereof extending perpendicular to a plane formed by the foot receiving area and by an aperture provided in the pre-formed upper;

measuring a height of the pre-formed upper to correspond with a height of the foot of the user and determining a position of securing the pre-formed upper to the sole; and stitching the pre-formed upper with a circumferential edge of the sole on the basis of the position of securing determined by measuring the height of the pre-formed upper to correspond with the height of the foot of the user to thereby join the pre-formed upper with the sole.

2. The method according to claim 1, wherein the insert is detachably applied to the prefabricated sole.

3. The method according to claim 1, wherein the insert is an orthopedic insert or appliance that is detachably applied to the sole.

4. The method according to claim 1, wherein the joining to the upper is carried out such that a lower edge region facing the sole extends essentially vertically.

5. The method according to claim 1, wherein the pre-formed upper is joined to the sole so as to surround the circumferential edge of the sole.

6. Fitted footwear, comprising:

a prefabricated sole;

a pre-formed upper; and an insert, wherein the footwear is produced according to claim 1.

* * * * *